US005923302A

United States Patent [19]

Waterman et al.

[11] Patent Number: 5,923,302

[45] **Date of Patent: *Jul. 13, 1999**

[54] FULL COVERAGE ANTENNA ARRAY INCLUDING SIDE LOOKING AND END-FREE ANTENNA ARRAYS HAVING COMPARABLE GAIN

[75] Inventors: Timothy G. Waterman, Eldersburg; William F. Hoover, Davidsonville, both of Md.

[73] Assignee: Northrop Grumman Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/489,569

[22] Filed: Jun. 12, 1995

[51] Int. Cl.[6] ..... H01Q 21/00

[52] U.S. Cl. ..... 343/846; 343/727; 343/833; 343/893

[58] Field of Search ..... 343/727, 725, 343/729, 705, 846, 853, 833, 834, 844, 893; H01Q 21/00

[56] References Cited

U.S. PATENT DOCUMENTS

| | | | |
|---|---|---|---|
| 2,417,808 | 3/1947 | Carter | 343/833 |
| 2,743,441 | 4/1956 | Granqvist | 343/815 |
| 3,096,520 | 7/1963 | Ehrenspeck | 343/833 |
| 3,404,396 | 10/1968 | Buehler et al. | 343/833 |
| 3,747,111 | 7/1973 | Fletcher et al. | 343/725 |
| 4,329,690 | 5/1982 | Parker | 343/725 |
| 4,608,572 | 8/1986 | Blakney et al. | 343/846 |
| 4,845,506 | 7/1989 | Shibata et al. | 343/770 |
| 4,933,680 | 6/1990 | Shapiro et al. | 343/700 MS |
| 5,132,698 | 7/1992 | Swineford | 343/846 |

OTHER PUBLICATIONS

F. Beltran, "Endfire Gain Enhancement . . ", AP–S International Symposium (Digest) ( IEEE Antennas & Propagation Society) 1982 May 24–28, Albuquerque, NM, USA.

Z. Yahang, et al., "Performance of Thinning . . ", AP–S International Symposium (Digest) ( IEEE Antennas & Propagation Society) 1988 Jun. 6–20, Albuquerque, NM, USA.

R.K. Arora, et al., "Synthesis of Linear . . ", AP–S International Symposium (Digest) (IEEE Antennas & Propagation Society) 1985 Jun. 17–19, Vancouver, BC, Canada.

A. Ishimaru, "Theory of Unequally–Spaced Arrays", *IRE Transactions on Antennas and Propagation*, Nov. 1962.

A. Ishimaru, et al., "Thinning and Broadbanding Antenna . . . " *IEEE Transactions on Antennas and Propagation*, Jan. 1965.

"Monopole Antennas" *Antenna Engineering Handbook* (Richard C. Johnson ed., 2nd ed. 1984) pp. 3–21—3–23.

"Arrays of Discrete Elements" *Antenna Engineering Handbook* (Richard C. Johnson ed., 3rd ed. 1993) pp. 3–1—3–34.

"Monopole Antennas" *Antenna Engineering Handbook* (Richard C. Johnson ed., 3rd ed. 1993) pp. 4–26—4–32.

*Primary Examiner*—Michael C. Wimer

[57] ABSTRACT

A full coverage antenna module provides radiation in 360° in a weight, space and cost effective manner. The antenna module includes two back-to-back electronically scanned (±60°) antenna arrays and an end-fire array mounted on at least one of a top surface and a bottom surface of the module. The end-fire array is bi-directional, may be scanned by ±30° in both of its directions, and serves as a gap filler to provide coverage not supplied by the side arrays. The end-fire array may include a plurality of rows of antenna elements, adjacent rows of which are separated by an offset width. Preferably, the antenna elements in the rows have a non-periodic inter-element spacing. The antenna elements in the end-fire array may be of different types, for example, both monopoles and dipoles may be used in the same end-fire array. If monopoles are used, they are preferably mounted on a corrugated ground plane.

19 Claims, 6 Drawing Sheets

FIG. 1a
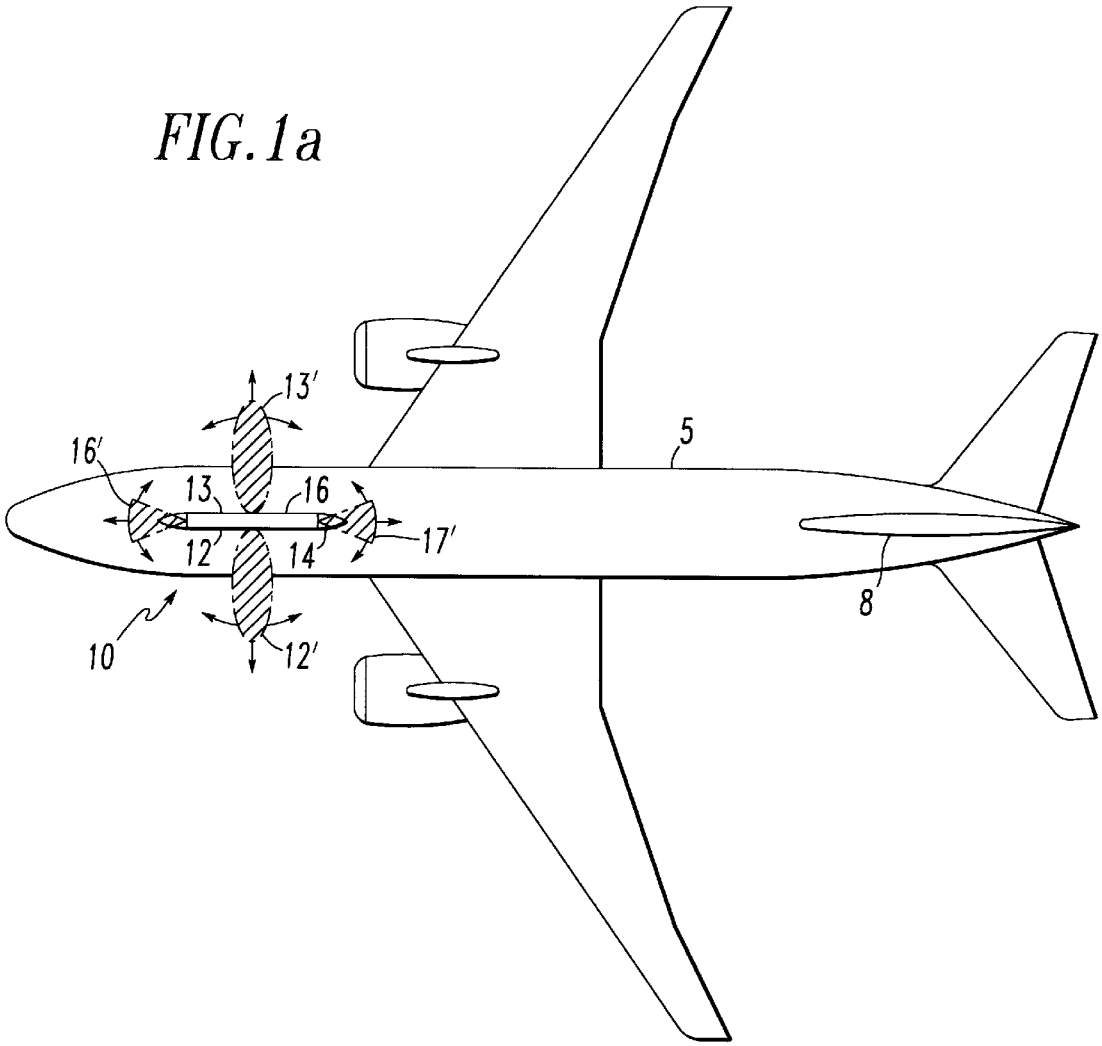
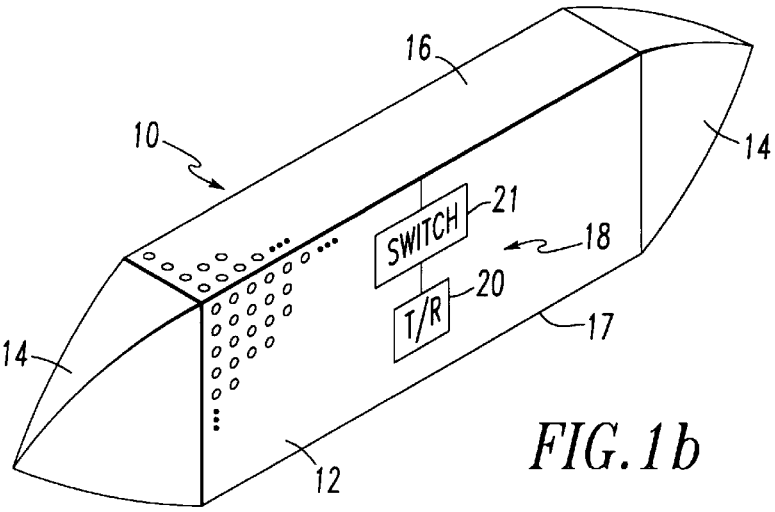
FIG. 1b

FIG. 1c
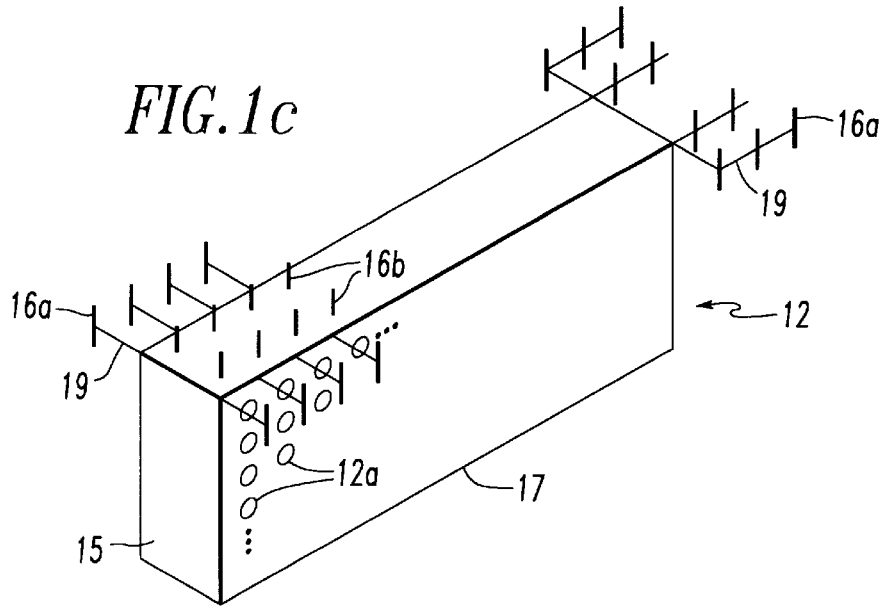
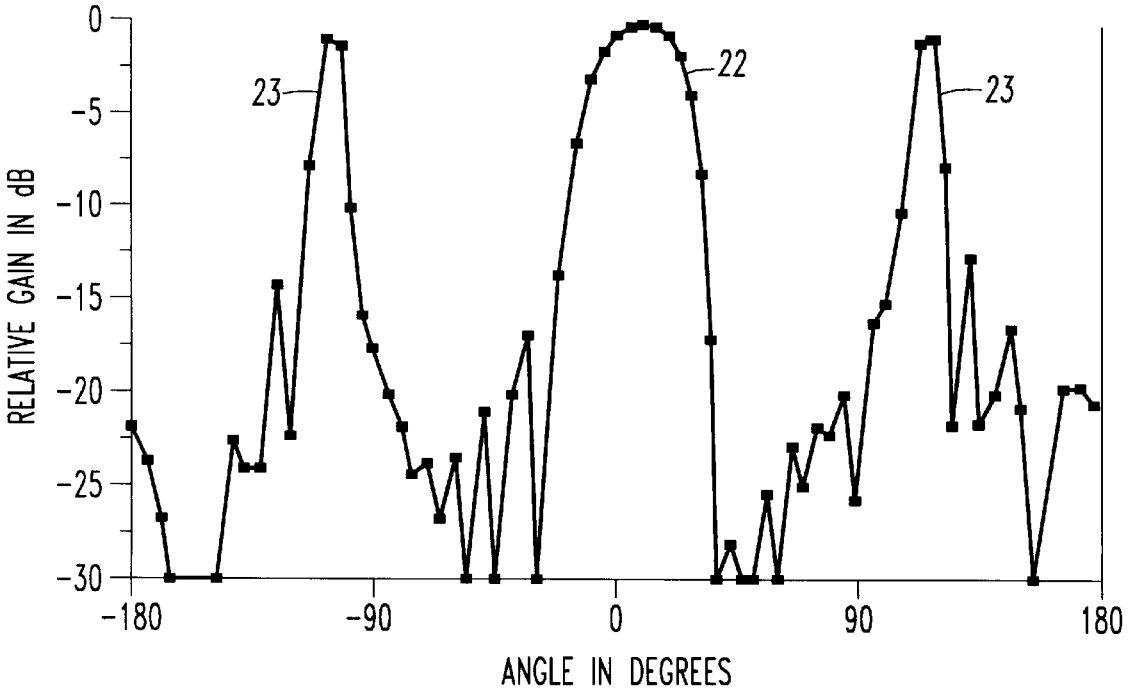
FIG. 2a
PRIOR ART

FIG.5a
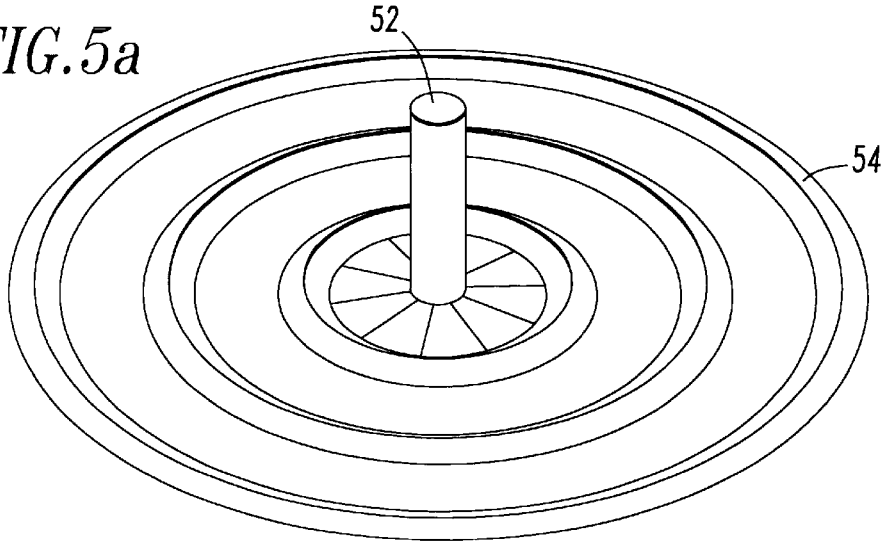
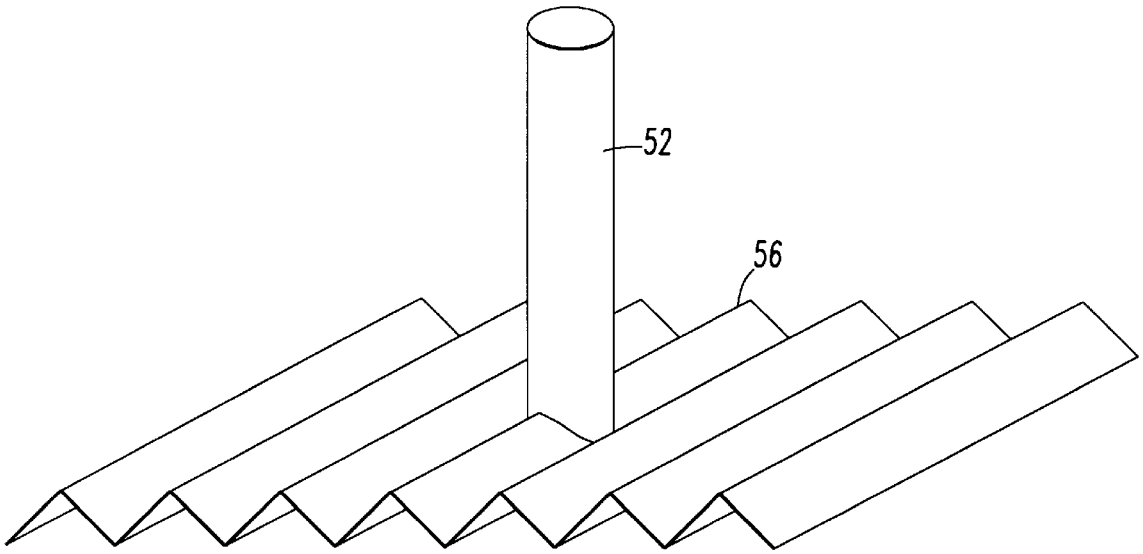
FIG.5b

FULL COVERAGE ANTENNA ARRAY INCLUDING SIDE LOOKING AND END-FREE ANTENNA ARRAYS HAVING COMPARABLE GAIN

BACKGROUND OF THE INVENTION

1. Field of the Invention

The present invention relates to an integrated, full coverage antenna module and, more particularly, to using an end-fire array capable of scan mounted on a top and/or a bottom surface of back-to-back side antenna arrays to form an integrated full coverage antenna module.

2. Description of the Related Art

It is desirable to have an antenna which provides 360° azimuth coverage. Such full coverage is particularly desirable for airborne radar. Radar applications desiring a full coverage antenna are numerous, including airborne early warning (AEW), navigation, weather mapping, et al.

Currently, AWACs provide full coverage by physically rotating an antenna around 360°. This configuration has the obvious problems of weight and mechanical requirements, as well as a fixed radar update rate.

An alternative to the rotating antenna is a dorsal fin array. The dorsal fin array is thin, light and requires no moving parts. This array consists of two conventional, electronically scanned antenna (ESA) arrays positioned back-to-back. Each of the ESA arrays usually can scan ±60° for a combined total of 240°, short of the desired 360°. Placing an array on either end of the back-to-back configuration, due to size constraints, won't allow these end arrays to provide nearly as much directive gain as the side-looking arrays, hence limiting the radar detection range.

Another solution consists of creating a triad array by joining three planar ESA arrays in a triangle. While providing full coverage with no mechanical parts, this configuration greatly increases the size and weight requirements of the device.

SUMMARY OF THE INVENTION

It is therefore an object of the present invention to provide an array having full 360° coverage with reduced system size, weight and cost, and which is free of moving parts. It is a further object of the present invention to provide an end-fire array having a high gain and an electronic scan capability.

These and other objects of the present invention are accomplished by providing a full coverage antenna module including a first antenna array, a second antenna array arranged back to back with the first antenna array, and a third antenna array positioned along at least one of a top surface and a bottom surface of the first and second antenna arrays. The full coverage antenna module may also include a fourth antenna array positioned along one of the top surface and the bottom surface of the first and second antenna arrays opposite the third antenna array.

The third and/or fourth antenna array is preferably an end-fire array. The end-fire antenna array may either simultaneously or sequentially radiate energy in a first direction and a second direction opposite the first direction. The full coverage antenna module may include a switch for alternating between supplying power to the end-fire array such that it radiates in a first direction and supplying power to the end-fire array such that it radiates in a second direction, opposite the first direction. The end-fire array preferably includes a plurality of rows of radiators, preferably non-periodically spaced radiators.

The end-fire array may include a plurality of monopoles mounted on a corrugated ground plane. Preferably, a depth of the corrugated ground plane is substantially $\lambda/8$ and a peak-to-peak spacing of the corrugated ground plane is substantially $\lambda/4$. The corrugations may be linear or annular.

The full coverage antenna module may further include a metallic structure surrounding electronics of the full coverage antenna module and the end-fire array may include monopoles mounted over the metallic structure and dipoles mounted around the monopoles.

The electronics of the full coverage antenna module may be shared between all of the first, second, third and/or fourth antenna arrays and include a switch for switching power supply between the arrays. Alternatively, each array may have its own electronics.

The objects of the present invention are also provided by positioning a first antenna array and a second antenna array back to back, positioning a third antenna array along one of a top surface and a bottom surface of the first and the second antenna arrays, and scanning the first,second and third antenna arrays to provide full coverage.

The full coverage method may further include switching between radiating energy from the third antenna array in a first direction and radiating energy from the third antenna array in a second direction, opposite the first direction. The full coverage method may include simultaneously radiating energy in a first direction and a second direction opposite the first direction from the third array.

The full coverage method may also include positioning a fourth antenna array along a surface opposite the third antenna array. This allows energy along a first direction to be radiated from the third antenna array and energy along a second direction, opposite the first direction, to be radiated from the fourth antenna array.

The full coverage method may also include sharing common electronics among all the antenna arrays, and switching supplying power between the first antenna array, the second antenna array, the third antenna array emitting in the first direction and the third and/or fourth antenna array emitting in the second direction. Alternatively,the full coverage method may include simultaneously radiating energy from all antenna arrays.

The full coverage method may further include corrugating a ground plane under monopoles in the third and/or fourth antenna array. The monopoles may be positioned above electronics in the full coverage antenna module and dipoles may be positioned around the monopoles.

These and other objects of the present invention will become more readily apparent from the detailed description given hereinafter. However, it should be understood that the detailed description and specific examples, will indicate the preferred embodiments of the present invention, are given by way of illustration, since various changes and modification within the spirit and scope of the invention will become apparent to those skilled in the art from this detailed description.

BRIEF DESCRIPTION OF THE DRAWINGS

The present invention will become more fully understood from the detailed description given herein below in the accompanying drawings which are given by way of illustration only, and thus are not limited to the present invention and wherein:

FIG. 1*a* is a top view of the 360° integrated antenna module of the present invention mounted on a platform and the areas of coverage provided by each array of the integrated antenna module;

FIG. 1*b* is a perspective side view of the 360° integrated antenna module of the present invention;

FIG. 1*c* is a perspective end view of the 360° integrated antenna module of the present invention;

FIG. 2*a* is a computed radiation pattern of an endfire array having evenly spaced elements;

FIG. 5*a* is an isometric view of a monopole mounted on an annular corrugated ground plane of the present invention; and FIG. 5*b* is an isometric view of a monopole mounted on a linear corrugated ground plane of the present invention.

DETAILED DESCRIPTION OF THE PREFERRED EMBODIMENTS

Figure 2B:
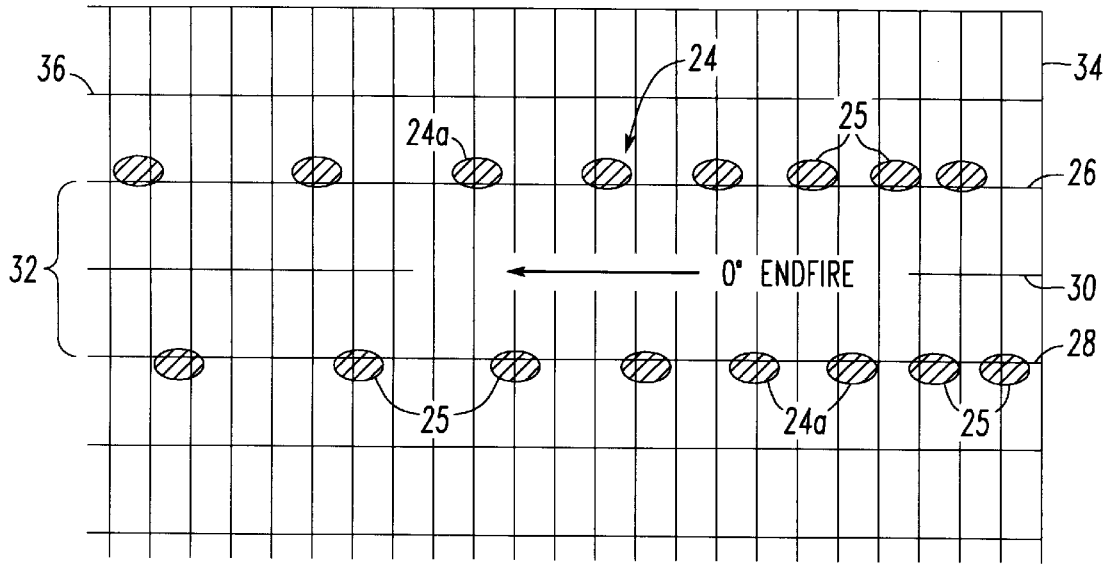
FIG. 2*b* is a top view of an end-fire array of the present invention.

As noted above, it is impractical to merely add antennas onto the ends of a dorsal fin array in order to achieve true full coverage, i.e., 360° coverage with sufficient gain. Rather than attempting to use a conventional broadside array as a coverage gap-filler, an array in which the elements are driven by currents with phase progressively varying along the longitudinal axis of the array, making the radiation substantially unidirectional along the longitudinal axis, may be used. Such an array is called an end-fire array. End-fire arrays are disclosed generally in Mark T. Ma, "Arrays of Discrete Elements", *Antenna Engineering Handbook*, Chapter 3 (Richard C. Johnson ed., 3rd ed. 1993).

When an end-fire array is placed along a top or a bottom surface of a dorsal fin array, the length of the dorsal fin array is sufficiently long that the gain achieved by the end-fire array is comparable to the gain in the side-looking arrays. When an end-fire array which may be scanned by ±30° is used to provide emission at both 0° and 180°, either sequentially or simultaneously, or end-fire arrays having opposite emission directions are positioned on the top and bottom surfaces, then, in conjunction with the range of coverage offered by the side-looking arrays noted above, full coverage of 360° may be achieved.

Such an integrated full coverage antenna module 10 is shown in FIG. 1*a*, in which the integrated full coverage antenna module 10 is mounted on a platform 5. The platform 5 may be an airplane as shown in FIG. 1*a*. The integrated full coverage antenna module 10, of which a direct top view is provided in FIG. 1*a*, includes a left side antenna array 12, a right side antenna array 13, and a top end-fire array 16 and/or a bottom end-fire array 17. Endcaps 14 are provided on the ends of the integrated full coverage antenna module 10.

As illustrated in FIG. 1*a*, each of these arrays 12, 13, 16, 17 is scanned over its respective viewing area. In particular, the left side array 12 radiates as indicated by a radiation pattern 12' to the left of the platform 5 and scans ±60° from the normal to the face of the left side array 12, as indicated by the side arrows on the radiation pattern 12'. Similarly, the right side array 13 radiates as indicated by a radiation pattern 13' to the right of the platform 5 and scans ±60° from the normal to the face of the right side array 13, as indicated by the side arrows on the radiation pattern 13'.

In the particular configuration shown in FIG. 1*a*, the top end-fire array 16 radiates as indicated by a radiation pattern 16' to the front of the platform 5 and scans ±30° along the longitudinal axis of the top end-fire array 16, as indicated by the side arrows on the radiation pattern 16'. Similarly, in the particular configuration shown in FIG. 1*a*, the bottom end-fire array 17 radiates as indicated by a radiation pattern 17' to the rear of the platform 5 and scans ±30° along the longitudinal axis of the bottom end-fire array 17, as indicated by the side arrows on the radiation pattern 17'. Alternatively, only one of the top and the bottom end-fire arrays may be used to provide either sequential or simultaneous bi-directional coverage.

For the particular platform 5, the integrated full coverage antenna module 10 advantageously has a height of approximately 72", a width of approximately 20" and a length of approximately 204". Including the endcaps 14 on the integrated antenna module 10 increase the length to approximately 276". The integrated full coverage antenna module 10 may be operated in the L-band.

FIG. 1*b* provides a perspective side view of the integrated array module 10 of the present invention. The right side array 13 cannot be seen in this view. As can be more clearly seen in FIG. 1*b*, the endcaps 14 may be aerodynamically shaped, since typically the integrated array module will be mounted in the conventional manner on an aircraft as shown in FIG. 1*a*.

Electronics 18 for all of the arrays of the integrated array module 10 are mounted within the integrated array module 10. These electronics may include a transmit/ receive (T/R) module 20 and a switch 21. In actuality, there are many T/R modules, only one of which has been shown for convenience. The T/R module 20 supplies energy to be radiated to the arrays. The switch 21 is only provided when the arrays are to be activated sequentially, and serves to switch the delivery of power to the different arrays of the integrated array module 10.

When all of the rows of the end-fire array 16, 17 are to radiate in the same direction, the end-fire array 16, 17 may immediately be phase shifted to output radiation 180° differently from its original direction by applying an opposite phase from a transmit/receive (T/R) module 20. Alternatively, the end-fire array 16, 17 may be constructed with a plurality of rows of radiating elements, some of which emit in one direction and others of which emit in an opposite direction. Thus, simultaneous bi-directional output is obtained from a single end-fire array 16 or 17.

When the integrated array module 10 is to be mounted far enough above a mounting surface such that energy emission therefrom is practical, i.e., the height of the array above the mounting surface should be approximately the wavelength to be radiated times the length of the array divided by the product of the width of the array and pi, for the example shown in FIG. 1*a*, at a height of greater than roughly three wavelengths from the surface, another alternative for providing bi-directional emission may be used. The array module 10 may then include the bottom end-fire array 17. The bottom end-fire array 17 would serve to emit energy in a direction opposite the emission direction of the top end-fire array 16, thereby providing the bi-directional emission as illustrated in FIG. 1*a*. Alternatively, both end-fire arrays 16, 17 may both be simultaneously bi-directional, as discussed above.

The electronics 18 may be shared between all of the arrays 12, 13, 16, 17 of the integrated antenna module 10. For example, the transmit/receive (T/R) module 20 of the electronics 18, of which there are many and a representative one is shown, which supplies the power to be radiated to the arrays may be alternated by the switch 22 both between the right side array 12, the left side array 13, and the top end-fire array 16 and/or the bottom end-fire array 17. Alternatively, if simultaneous emission from all arrays is desired, each array may have its own electronics.

In FIG. 1*c*, the individual radiating elements 12*a* of the conventional left side array 12 can be seen. A metallic structure 15 which surrounds the electronics 18 is also shown. The details of the configuration of the top end-fire array 16 shown in FIG. 1*c* will be discussed after the following general discussion of end-fire arrays. While the following discussion is general to end-fire arrays, it is to be understood that any of the various array configurations discussed may be used for either the top end-fire array 16 or the bottom end-fire array 17, and that the configurations for the top and bottom arrays do not have to be the same.

Most commonly, an end-fire array consists of equally spaced co-polarized radiating elements arranged in a collinear fashion. However, such regularly spaced end-fire arrays are band limited in that once the inter-element spacing reaches $\lambda/2$, a grating lobe appears in the back hemisphere, as can be seen in FIG. 2*a*. These grating lobes 23 are at the same frequency and have the same peak gain as the desired main beam 22, but are in different directions than that of the desired main beam 22.

Further, in such a regularly spaced array, adjacent elements affect each others' input impedance. Due to this mutual coupling, the energy being radiated out of a given element, especially those elements closer to the leading edge of the array, may be overwhelmed by fields coupling in from neighboring elements. By providing non-periodic spacing, elements can be spaced farther apart, the problem of mutual coupling may be mitigated and the periodic phase required to form strong grating lobes is eliminated. In addition, the use of a non-periodic spaced array allows the number of elements needed in the array to cover the full length to be reduced and the frequency bandwidth to be broadened.

Therefore, according to the present invention, an end-fire array 24 is advantageously configured as shown in FIG. 2*b*. In this end-fire array 24, array elements or radiators 24*a* are formed along two rows 26, 28 separated by a width offset 32 about a central axis 30 along which end-fire with 0° steering occurs. The width offset between rows should be determined to maximize aperture while suppressing grating lobes, typically around $0.8\lambda$. For arrays having more than two rows, this width offset may be different for each pair of adjacent rows.

Along each of the rows 26, 28, the array elements 24*a* are separated by progressively increasing inter-element spacing 25 from a trailing edge 34 to a leading edge 36 of the end-fire array 24. The spacing shown in FIG. 2*b* is not critical, although it is advantageous. Any non-periodic spacing of the array elements is useful in mitigating the mutual coupling problem. When the array 24 is switched to radiate in an opposite direction, it does not matter for the desired effect that the resulting pattern now has a decreasing inter-element spacing, as long as the inter-element spacing 25 remains non-periodic.

Figure 2C:
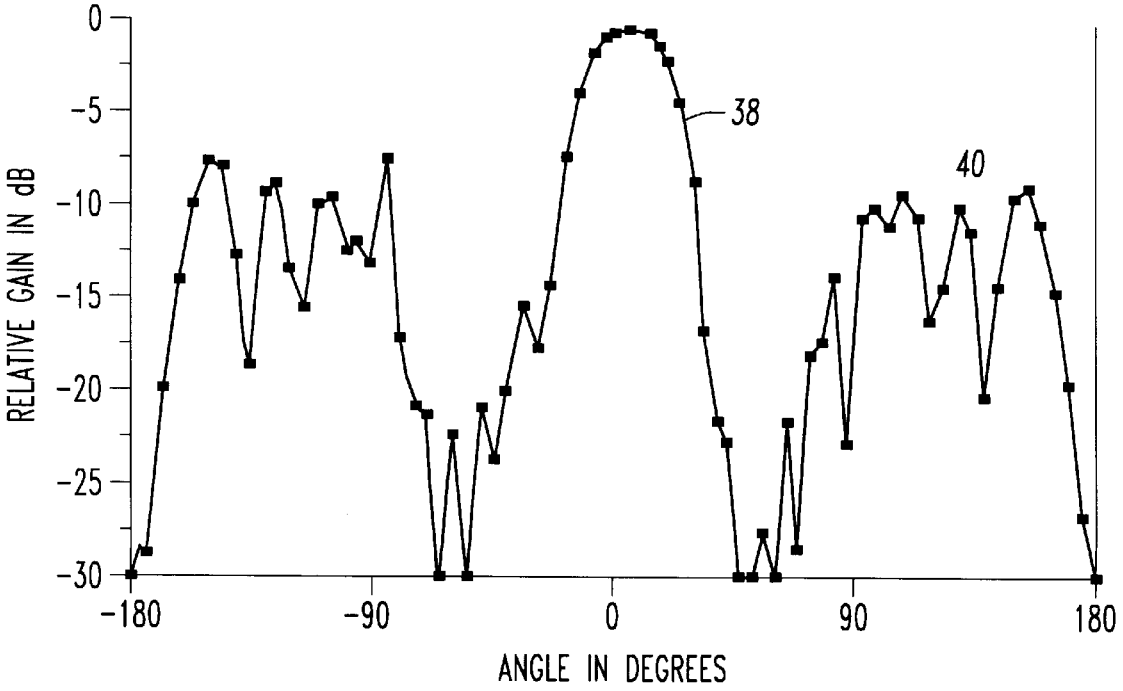
FIG. 2*c* is a computed radiation pattern of the array in FIG. 2*b;*

As can be seen in FIG. 2*c*, side lobes 40 from the end-fire array 24 shown in FIG. 2*b* have peaks which are much lower than the peak of the main beam 38. These side lobes 40 also are much lower than the grating lobes 23 in FIG. 2*a*.

The array elements of an end-fire array do not all have to be the same type of element. As can be seen in FIG. 1*c*, for example, for the top end-fire array 16, it is advantageous to use monopoles 16*b* over the metallic structure 15 containing electronics 18 of the integrated array module 10, and to use dipoles 16*a* for those array elements which are not over the metallic structure 15. The dipoles 16*a* are connected to the metallic structure 15 and to each other by a connector 19 made of a non-conducting material such as plastic. The dipoles may be positioned to extend beyond the sides and the ends of the metallic structure 15, and may result in the top end-fire array 16 having a length of 276" and a width of 30". Clearly this configuration could also be used for the bottom end-fire array 17 as well.

Figure 3A:
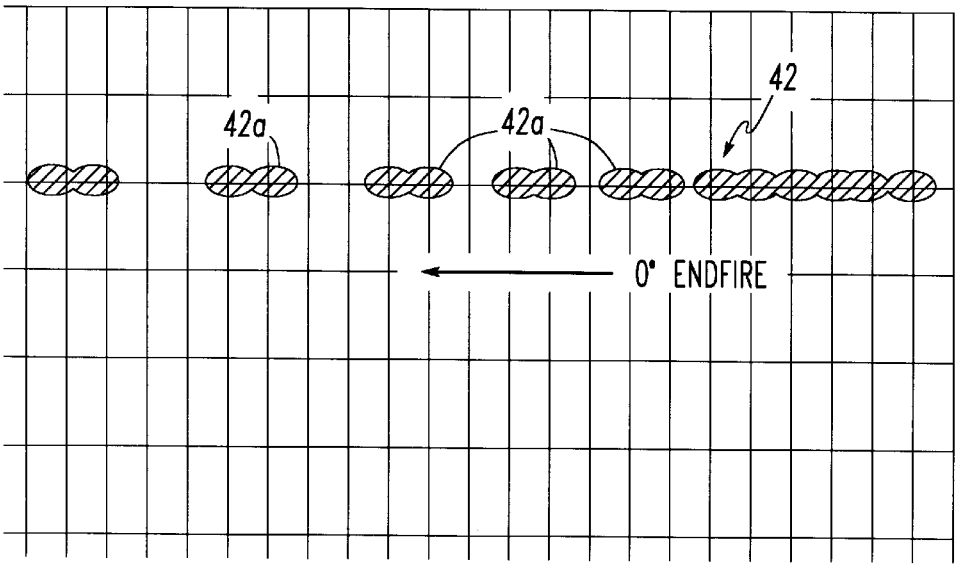
FIG. 3*a* is a top view of a collinear array of the present invention.
Figure 3B:
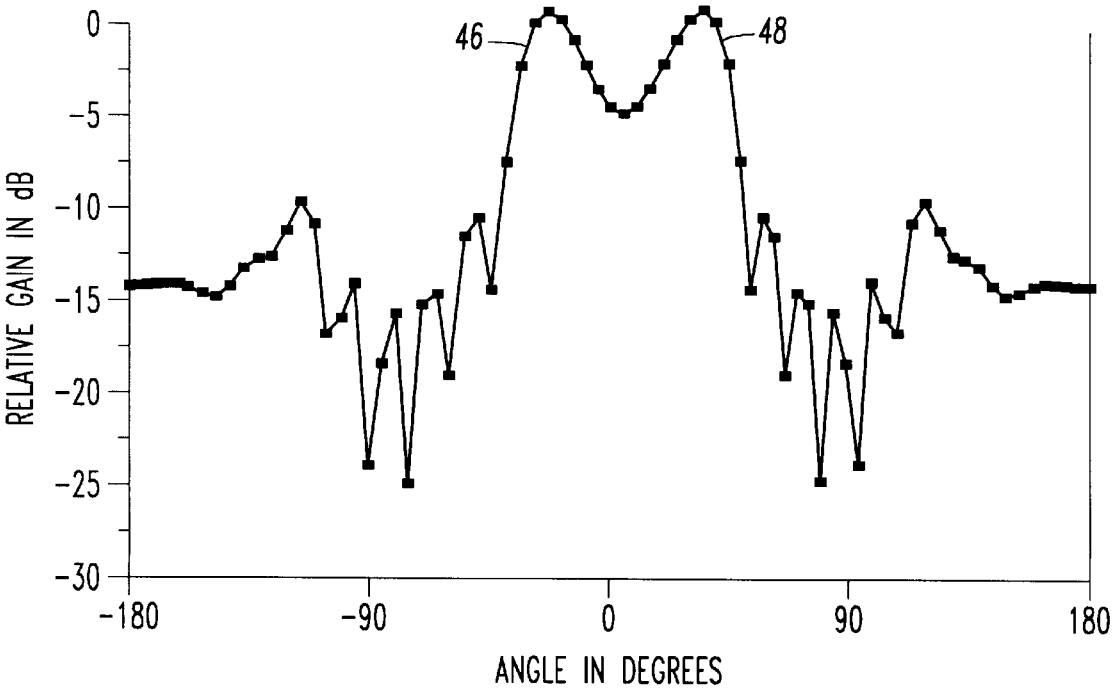
FIG. 3*b* is a computed radiation pattern of the array shown in FIG. 3*a*, when the array has been scanned to 30°.

The array elements of an end-fire array do not have to be configured in only two rows around the central axis as shown in FIG. 2*b*, but may include a plurality of rows, as shown in FIG. 1*c* or may be collinear, as shown in array 42 in FIG. 3*a*. The collinear array elements 42*a* are still arranged with an uneven inter-element spacing. A disadvantage of the collinear end-fire array 42 shown in FIG. 3*a* can be seen in FIG. 3*b*, wherein scanning of the array in FIG. 3*a* to 30° results in a beam having two peaks 46, 48.

Figure 3C:
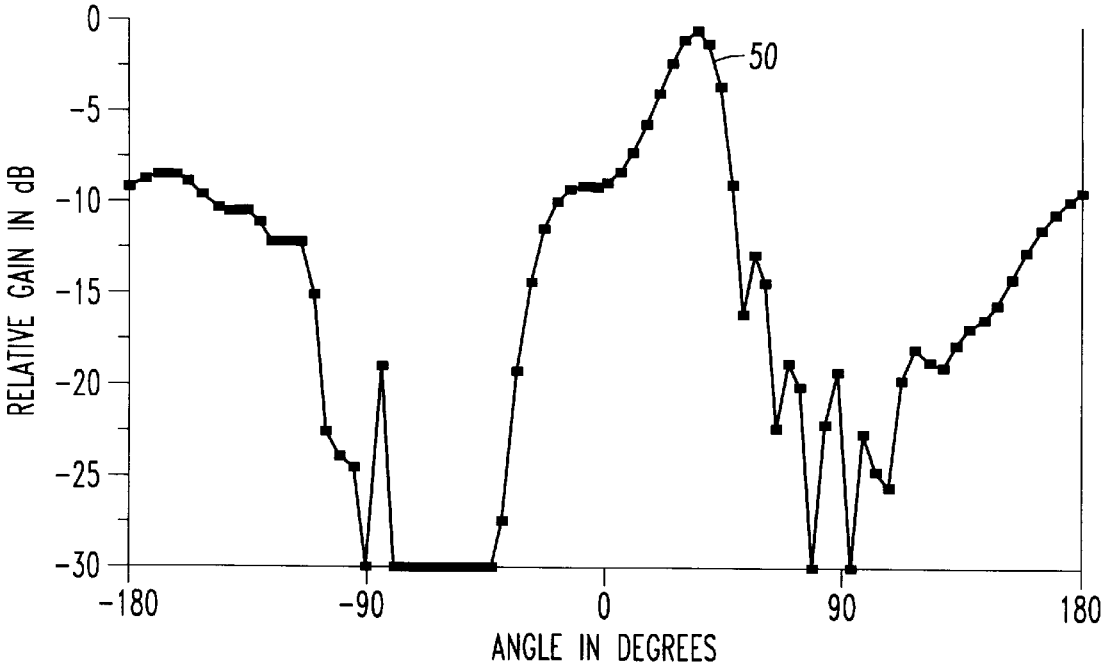
FIG. 3*c* is a computed radiation pattern of the array shown in FIG. 2*b* scanned to 30°.

As can be seen in FIG. 3*c*, when the two row array of FIG. 2*a* is used and steered to 30°, the radiation pattern results in only a single peak 50. Therefore, for steering, it is advantageous to have at least two rows in an end-fire array. Further, when the end-fire array is to be mounted on a platform 5, for example an airplane as shown in FIG. 1*a*, the provision of the additional rows in the end-fire array allows the end-fire array to "see around" an obstruction, i.e., not to have its view completely blocked by any obstruction present on the platform 5, e.g., the vertical stabilizer tail section 8 of the airplane platform 5 shown in FIG. 1*a*.

Figure 4:
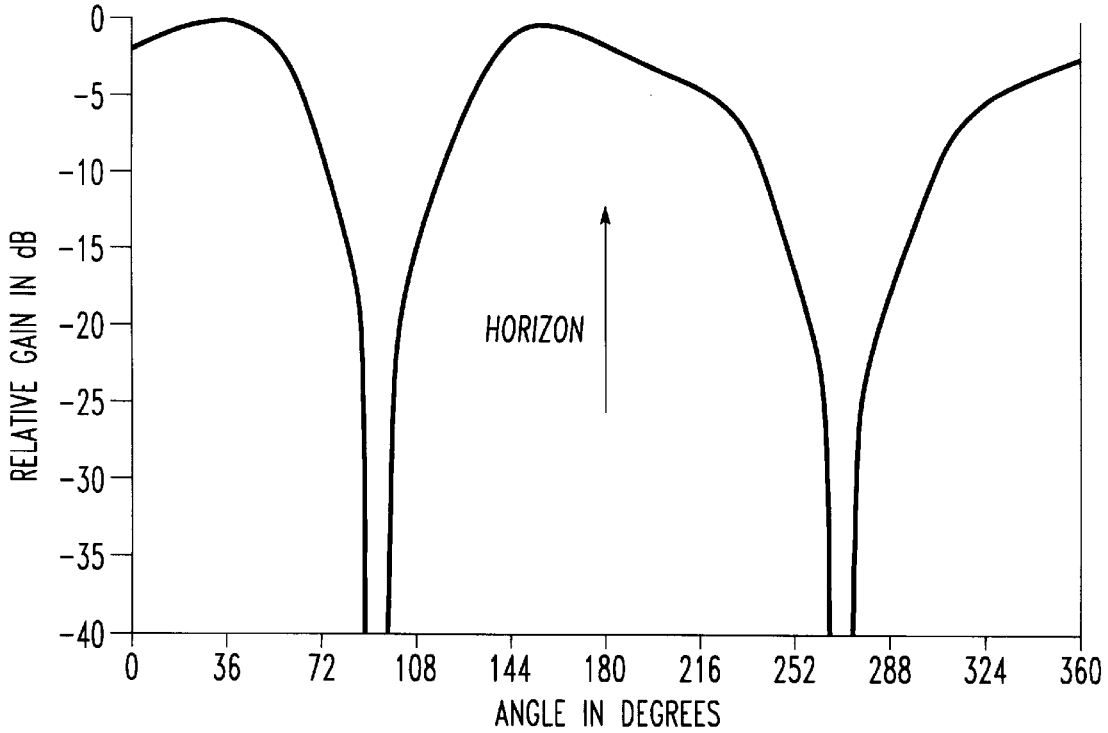
FIG.4 PRIOR ART
FIG. 4 is a computed radiation pattern from a monopole mounted on a finite flat ground plane.

When using monopoles as part of the end-fire array, as shown in FIG. 1*c*, if these monopoles are mounted on a flat ground plane, a well known problem is that the beam has a maximum above the horizon, not on the horizon, as can be seen in FIG. 4. This can be a problem for end-fire arrays that desire maximum gain on the axis of the antenna. Other elements that may do a better job of maintaining the beam at the horizon, such as a $\lambda/2$ dipole suspended over a ground plane, have an impedance change over frequency that is larger and a size that is bigger than that of the monopole, all of which are undesirable for the present configuration. Monopoles are disclosed generally in Chen T. Tai "Monopole Antennas", *Antenna Engineering Handbook*, Section 4–8 (Richard C. Johnson ed., 3rd ed. 1993).

In accordance with the present invention, by using a corrugated ground plane, the beam emitted from a monopole may be more aligned with the horizon. The corrugated ground plane, on which a representative monopole 52 is mounted, may be an annular corrugated ground plane 54 for omni-directional use shown in FIG. 5*a*, or the desired configuration for the end-fire application of the present invention of a linear corrugated ground plane 56 shown in FIG. 5*b*.

Advantageously, this corrugated ground plane 54 or 56 has a depth of $\lambda/8$ and a spacing of $\lambda/4$ from peak to peak. Thus, the resulting increase in height of this configuration is only $\lambda/8$ from that of a flat ground plane. Unlike corrugations which have been used before in applications other than ground planes for monopoles, in which surface waves are intended to be precluded, the depth of the corrugated ground planes of the present invention are not suppressing the surface waves by producing cavities with depths designed so that it presents a high impedance, but rather enhances the surface waves to improve the alignment of the output. As usual, the corrugated ground plane 54, 56 may be made of any conducting material, such as copper or aluminum.

The invention being thus described, it will be obvious that the same may be varied in many ways. For example, the conventional end arrays mentioned in the background may be used in conjunction with the top and/or bottom mounted end-fire arrays of the present invention. Further, in addition to the monopoles and dipoles described, other radiators, such as highly directive elements, e.g., Yagi-Uda antennas, may be employed as the radiating elements of the end-fire array of the present invention. Such variations are not to be regarded as a departure from the spirit and scope of the invention, and all such modifications as would be obvious to one skilled in the art are intended to be included within the scope of the following claims.

What is claimed is:

1. A full coverage antenna module comprising:

a first sidelooking antenna array;

a second sidelooking antenna array arranged back to back with said first antenna array such that said first and second sidelooking arrays observe opposite sides; and a first end-fire antenna array positioned along at least one of a top surface and a bottom surface formed by said first and second sidelooking antenna arrays, said first end-fire antenna array having a number of active elements substantially the same as a number of active elements of one of said first sidelooking antenna array and said second sidelooking antenna array such that a gain of said first end-fire antenna array is substantially the same as a gain of one of said first sidelooking antenna array and said second sidelooking antenna array.

2. The full coverage antenna module as recited in claim 1, further comprising a second end-fire antenna array positioned along one of said top surface and said bottom surface formed by said first and second antenna arrays opposite said first end-fire antenna array.

3. The full coverage antenna module as recited in claim 1, further comprising means for alternating between supplying power to said first end-fire antenna array such that it radiates in a first direction and supplying power to said first end-fire antenna array such that it radiates in a second direction, opposite said first direction.

4. The full coverage antenna module as recited in claim 1, wherein said first end-fire antenna array simultaneously radiates energy in a first direction and a second direction opposite said first direction.

5. The full coverage antenna module as recited in claim 1, wherein said first end-fire antenna array comprises a row of non-periodically spaced radiators.

6. The full coverage antenna module as recited in claim 1, wherein said first end-fire antenna array comprises a plurality of rows of radiators.

7. The full coverage antenna module as recited in claim 1, further comprising electronics shared between all of said first sidelooking, second sidelooking and first end-fire antenna arrays and means for switching power supply between said first sidelooking, second sidelooking and first end-fire arrays.

8. The full coverage antenna module as recited in claim 1, wherein said first end-fire antenna array comprises a plurality of monopoles mounted on a-corrugated ground plane.

9. The full coverage antenna module as recited in claim 8, wherein a depth of said corrugated ground plane is substantially $\lambda/8$ and a peak-to-peak spacing of said corrugated ground plane is substantially $\lambda/4$.

10. The full coverage antenna module as recited in claim 1, further comprising a metallic structure surrounding electronics of the full coverage antenna module and wherein said first end-fire antenna array comprises monopoles mounted over said metallic structure and dipoles mounted around said monopoles.

11. A method of providing full coverage by an integrated antenna module comprising the steps of:

positioning a first sidelooking antenna array and a second sidelooking antenna array back to back such that said first and second sidelooking arrays observe opposite sides;

positioning a first end-fire antenna array along one of a top surface and a bottom surface formed by said positioning of said first and said second sidelooking antenna arrays, said first endfire array having a number of active elements substantially the same as a number of active elements of one of said first sidelooking array and said second sidelooking array, such that a gain of said first end-fire array is substantially the same as a gain of one of said first sidelooking antenna array and said second sidelooking antenna array; and scanning said first sidelooking, second sidelooking and first end-fire antenna arrays to provide full coverage.

12. The method as recited in claim 11, further comprising switching between radiating energy from said first end-fire antenna array in a first direction and radiating energy from said first end-fire antenna array in a second direction, opposite said first direction.

13. The method as recited in claim 11, further comprising positioning a second end-fire antenna array along one of said top surface and said bottom surface, opposite said first end-fire antenna array.

14. The method as recited in claim 14, further comprising radiating energy along a first direction from said first end-fire antenna array and radiating energy along a second direction, opposite said first direction, from said second end-fire antenna array.

15. The method according to claim 11, further comprising:

sharing common electronics among all three antenna arrays; and switching supplying power between said first sidelooking antenna array, said second sidelooking antenna array, said first end-fire antenna array emitting in a first direction and said first end-fire antenna array emitting in a second direction opposite said first direction.

16. The method as recited in claim 11, further comprising simultaneously radiating energy from all three antenna arrays.

17. The method as recited in claim 11, further comprising simultaneously radiating energy in a first direction and a second direction opposite said first direction from said first end-fire array.

18. The method as recited in claim 11, further comprising corrugating a ground plane under monopoles in said first end-fire antenna array.

19. The method as recited in claim 17, further comprising positioning monopoles in said first end-fire antenna array above electronics in the full coverage antenna module and positioning dipoles in said first end-fire antenna array around said monopoles.

* * * * *